US011400728B2

(12) United States Patent
Furuichi et al.

(10) Patent No.: US 11,400,728 B2
(45) Date of Patent: Aug. 2, 2022

(54) PRINTING APPARATUS AND PRINTING METHOD

(71) Applicant: SCREEN HOLDINGS CO., LTD., Kyoto (JP)

(72) Inventors: Koji Furuichi, Kyoto (JP); Tadayoshi Suyama, Kyoto (JP); Shuangning Wang, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 130 days.

(21) Appl. No.: 16/968,807

(22) PCT Filed: Nov. 16, 2018

(86) PCT No.: PCT/JP2018/042478
§ 371 (c)(1),
(2) Date: Aug. 10, 2020

(87) PCT Pub. No.: WO2019/167354
PCT Pub. Date: Sep. 6, 2019

(65) Prior Publication Data

US 2020/0398559 A1 Dec. 24, 2020

(30) Foreign Application Priority Data

Feb. 27, 2018 (JP) ..... JP2018-032829

(51) Int. Cl.
*B41J 2/21* (2006.01)

(52) U.S. Cl.
CPC ..... *B41J 2/2103* (2013.01)

(58) Field of Classification Search
CPC ..... B41J 2/2103
See application file for complete search history.

(56) References Cited

U.S. PATENT DOCUMENTS

2001/0030669 A1 10/2001 Mizutani
2002/0154183 A1 10/2002 Mizutani
2004/0239721 A1 12/2004 Usuda
(Continued)

FOREIGN PATENT DOCUMENTS

EP 1 048 466 A2 11/2000
JP 11-347468 A 12/1999
(Continued)

OTHER PUBLICATIONS

Japanese Notice of Reasons for Refusal issued in corresponding Japanese Patent Application No. 2018-032829, dated Oct. 26, 2021, with English translation.
(Continued)

*Primary Examiner* — Justin Seo
(74) *Attorney, Agent, or Firm* — McDermott Will & Emery LLP

(57) ABSTRACT

The area of the openings Ow that discharges the white ink is larger than the area of the openings Ot that discharges the color inks. Since the openings Ow are secured to be large in this way, more white ink can be discharged to one pixel while the number of ink droplets discharged by the multi-drop method is suppressed or without depending on the multi-drop method. As a result, a generation amount of an ink mist can be suppressed while the discharge amount of the white ink is secured.

6 Claims, 2 Drawing Sheets

(56) References Cited

U.S. PATENT DOCUMENTS

| | | | | |
|---|---|---|---|---|
| 2012/0169803 | A1 | 7/2012 | Takamura | |
| 2012/0200649 | A1 | 8/2012 | Igawa et al. | |
| 2012/0249671 | A1* | 10/2012 | Shimizu | B41J 2/16508 347/29 |
| 2016/0297207 | A1 | 10/2016 | Chang | |

FOREIGN PATENT DOCUMENTS

| | | | |
|---|---|---|---|
| JP | 2001-347663 | A | 12/2001 |
| JP | 2004-018546 | A | 1/2004 |
| JP | 2005-088520 | A | 4/2005 |
| JP | 3715463 | B2 | 11/2005 |
| JP | 2009-285845 | A | 12/2009 |
| JP | 2011-083907 | A | 4/2011 |
| JP | 2012-139940 | A | 7/2012 |
| KR | 10-2007-0053040 | A | 5/2007 |

OTHER PUBLICATIONS

International Search Report issued in corresponding International Patent Application No. PCT/JP2018/042478, dated Jan. 8, 2019, with English translation.

Partial European Search Report issued in corresponding European Patent Application No. 18908201.9-1017, dated Nov. 11, 2021.

* cited by examiner

PRINTING APPARATUS AND PRINTING METHOD

CROSS REFERENCE TO RELATED APPLICATIONS

This application is the U.S. National Phase under 35 U.S.C. § 371 of International Application No. PCT/JP2018/042478, filed on Nov. 16, 2018, which claims the benefit of Japanese Application No. 2018-032829, filed on Feb. 27, 2018, the entire contents of each are hereby incorporated by reference.

TECHNICAL FIELD

This invention relates to a technique for printing by discharging an ink to a print medium.

BACKGROUND ART

Conventionally, a printing apparatus has been generally used which prints an image by discharging each of inks of a plurality of colors by an ink-jet method. In such a printing apparatus, the amount of the ink discharged to one pixel, i.e. a discharge amount, may differ depending on colors. Typically, in an ink-jet printing apparatus using color inks and a white ink to represent a color image, a discharge amount of the white ink is larger than those of the color inks. This is because a large amount of the white ink is used, such as to print a background around a color image or to increase a concealment rate by overlaying the white ink on the color image as shown in patent literature 1.

CITATION LIST

Patent Literature

[PTL 1] JP2012-139940

SUMMARY

Technical Problem

To secure the discharge amount, a multi-drop method described, for example, in patent literature 1 can be used. This multi-drop method is a technique for successively discharging a plurality of ink droplets to one pixel, and the plurality of ink droplets are joined until landing on a print medium by making a discharge speed of the later discharged ink droplets faster than that of the previously discharged ink droplets. However, since an ink mist is generated when the ink droplets are joined, more ink mist is generated as the number of the ink droplets discharged to one pixel increases, which might contaminate the inside of the printing apparatus.

This invention was developed in view of the above problem and aims to provide a technique capable of suppressing a generation amount of an ink mist while securing an ink discharge amount.

Solution to Problem

A printing apparatus according to the invention, comprises: a first printing unit that discharges a first ink to a print medium from a first opening, a second printing unit that discharges a second ink having a color different from a color of the first ink to the print medium from a second opening, and a controller that controls discharge of the first ink from the first opening by the first printing unit and discharge of the second ink from the second opening by the second printing unit, wherein an area of the first opening is larger than an area of the second opening.

A printing method according to the invention, comprises: discharging a first ink to a print medium from a first opening; and discharging a second ink having a color different from a color of the first ink from a second opening, wherein an area of the first opening is larger than an area of the second opening.

In the invention (printing apparatus and printing method) thus configured, the area of the first opening that discharges the first ink is larger than the area of the second opening that discharges the second ink. Since the first opening is secured to be large in this way, more first ink can be discharged to one pixel while the number of ink droplets discharged in a multi-drop method is suppressed or without depending on the multi-drop method. As a result, a generation amount of an ink mist can be suppressed while a discharge amount of the ink (first ink) is secured.

The printing apparatus may further comprises a conveying unit that conveys the print medium in a predetermined conveying direction, wherein: the controller causes the first ink discharged from the first opening at a timing corresponding to a first drive signal to land on the print medium being conveyed in the conveying direction by inputting the first drive signal to the first printing unit and causes the second ink discharged from the second opening at a timing corresponding to a second drive signal to land on the print medium being conveyed in the conveying direction by inputting the second drive signal to the second printing unit.

That is, if it is tried to secure the discharge amount of the first ink larger than the discharge amount of the second ink, it has been necessary to input a first drive signal having a large amplitude to the first printing unit to discharge a large amount of the first ink. However, a conveying speed of the print medium had to be delayed and the efficiency of printing was reduced in some cases since this first drive signal could not keep up with the conveying speed of the print medium. In contrast, by making the area of the first opening that discharges the first ink larger than the area of the second opening that discharges the second ink, the amplitude of the first drive signal required for the discharge of the first ink can be suppressed to be small and a necessary amount of the first ink can be discharged to the print medium while the print medium is conveyed at a high speed. In this way, printing can be efficiently performed.

The printing apparatus may be configured so that a width of the first opening and a width of the second opening are equal in a direction orthogonal to the conveying direction, and a length of the first opening is longer than a length of the second opening in the conveying direction. By making the first opening large in the conveying direction of the print medium in this way, a necessary amount of the first ink can be discharged to the print medium and efficient printing can be performed while the print medium is conveyed at a high speed.

The printing apparatus may be configured so that the controller causes the first ink discharged from the first printing unit and the second ink discharged from the second printing unit to be overlaid on the print medium. In such a configuration, a sufficient concealment rate of a color image formed by the second ink can be ensured by overlaying a large amount of the first ink on the second ink.

The printing apparatus may further comprises: a first pressure regulation mechanism that forms a meniscus of the first ink by regulating a pressure of the first ink in the first printing unit; and a second pressure regulation mechanism that forms a meniscus of the second ink by regulating a pressure of the second ink in the second printing unit. In such a configuration, the pressure to form the meniscus of the first ink and the pressure to form the meniscus of the second ink are individually regulated. Thus, the meniscuses of the respective first and second inks can be properly shaped by giving pressures corresponding to the areas of the respective first and second openings.

The printing apparatus may be configured so that the first ink is a white ink and the second ink is an ink of a color other than white. In such a configuration, the generation amount of the ink mist can be suppressed while a large discharge amount of the white ink used, such as to print a background image or to supplement the concealment rate, is secured.

The printing apparatus may be configured so that the controller controls such that a maximum value of an amount of the first ink discharged to one pixel from the first opening by the first printing unit is larger than a maximum value of an amount of the second ink discharged to one pixel from the second opening by the second printing unit. That is, in such a configuration, the first opening to discharge the first ink having a larger maximum value of the discharge amount (amount of the ink discharged to one pixel) than the second ink is secured to be large. As a result, the generation amount of the ink mist can be suppressed while the maximum value of the discharge amount of the ink (first ink) is secured.

Advantageous Effects of Invention

As described above, according to the invention, it is possible to suppress a generation amount of an ink mist while securing an ink discharge amount.

DESCRIPTION OF EMBODIMENTS

Figure 1:
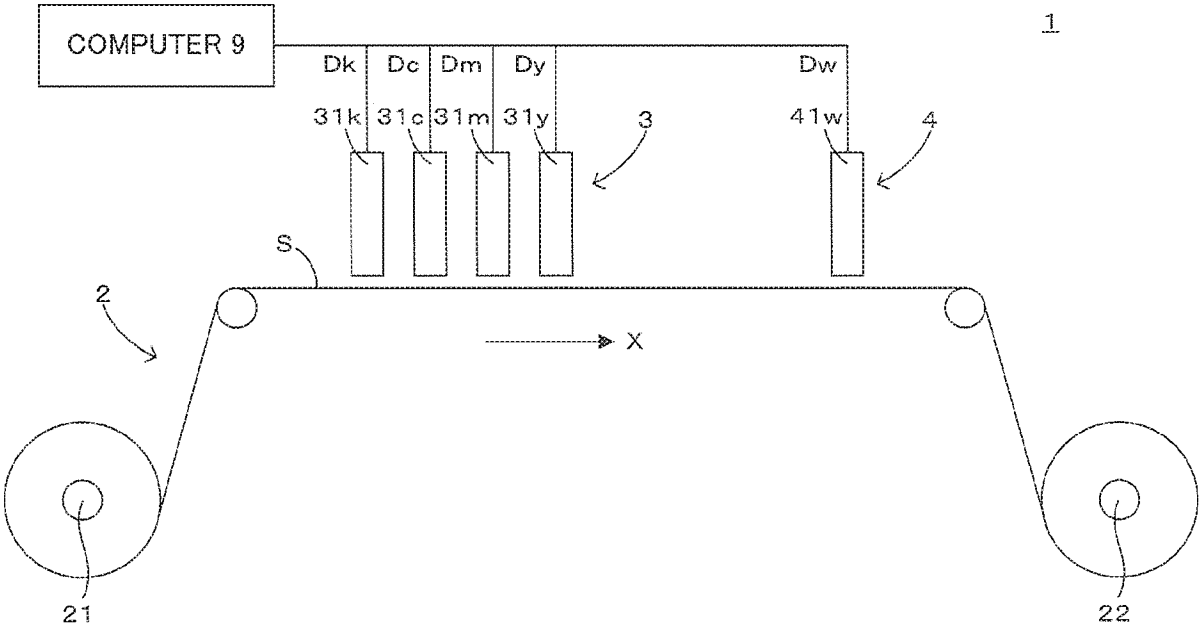
FIG. 1 is a front view schematically showing an example of a printing apparatus according to one embodiment of the invention.

FIG. 1 is a front view schematically showing an example of a printing apparatus according to one embodiment of the invention. The printing apparatus 1 of FIG. 1 includes a conveying unit 2 configured to convey a sheet S in a conveying direction X, a color printing unit 3 configured to print a color image on the sheet S and a base printing unit 4 configured to print a white image on the sheet S.

The sheet S is a flexible packaging material such as a film or cellophane of PET (polyethylene terephthalate), nylon, OPP (oriented polypropylene) or CPP (cast polypropylene), and transparent. Note that "transparency" indicates a property of transmitting visible light and includes colorless transparency and colored transparency in this specification.

The conveying unit 2 includes a feed roller 21 that feeds the sheet S wound into a roll and a wind-up roller 22 that winds the sheet S into a roll. By winding the sheet S fed by the feed roller 21 by the wind roller 22, the sheet S is conveyed in a roll-to-roll manner in the conveying direction X.

The color printing unit 3 includes a plurality of (four) discharge heads 31*k*, 31*c*, 31*m* and 31*y* that discharge inks to the sheet S being conveyed in the conveying direction X by an ink-jet method. These discharge heads 31*k*, 31*c*, 31*m* and 31*y* are arranged in this order in the conveying direction X. The discharge head 31*k* discharges the ink of black (K), the discharge head 31*c* discharges the ink of cyan (C), the discharge head 31*m* discharges the ink of magenta (M) and the discharge head 31*y* discharges the ink of yellow (Y). Note that the inks of K, C, M and Y are collectively called color inks.

The base printing unit 4 includes a discharge head 41*w* that discharge an ink to a color image on the sheet S being conveyed in the conveying direction X on a side downstream of the color printing unit 3 in the conveying direction X by the ink-jet method. This discharge head 41*w* is arranged downstream of the four discharge heads 31*k*, 31*c*, 31*m* and 31*y* of the color printing unit 3 in the conveying direction X and discharges an ink of white (W).

A particle diameter of a pigment included in the white ink discharged from the base printing unit 4 is larger than a particle diameter of pigments included in the color inks. Out of the white ink discharged from the discharge head 41*w*, the white ink landed on a background region where the color image is not printed forms a background image and the white ink landed and overlaid on the color image forms a concealment auxiliary image for compensating for the shortage of a concealment rate of the color image.

In this way, the white ink is printed after the color image is printed on a printing surface of the sheet S. By performing printing in this order, the color image (foreground image) visible from a non-printed surface side (side opposite to the printing surface) of the sheet S and surrounded by the white background image can be printed.

Further, the printing apparatus 1 includes a computer 9 that controls the color printing unit 3 and the base printing unit 4. The aforementioned discharge heads 31*k*, 31*c*, 31*m*, 31*y* and 41*w* discharge the inks based on a control of the computer 9. That is, the computer 9 inputs drive signals Dk, Dc, Dm and Dy for causing the discharge heads 31*k*, 31*c*, 31*m* and 31*y* to respectively discharge the color inks at timings corresponding to the conveyance of the sheet S in the conveying direction X to the discharge heads 31*k*, 31*c*, 31*m* and 31*y*. Then, each of the discharge heads 31*k*, 31*c*, 31*m* and 31*y* discharges the color ink of the corresponding color at the timing indicated by the drive signal Dk, Dc, Dm, Dy and causes the color ink to land on the sheet S. Further, the computer 9 inputs a drive signal Dw for causing the discharge head 41*w* to discharge the white ink at a timing corresponding to the conveyance of the sheet S in the conveying direction X to the discharge head 41*w*. Then, the discharge head 41*w* discharges the white ink at the timing indicated by the drive signal Dw and causes the white ink to land on the sheet S. Note that a multi-drop method may be used to discharge the inks from the discharge heads 31*k*, 31*c*, 31*m*, 31*y* and 41*w* or a method other than the multi-drop method (i.e. a method for discharging one ink droplet to one pixel) may be used.

Such a computer 9 controls the drive signals Dk, Dc, Dm, Dy and Dw such that amounts of the inks corresponding to a halftone value are discharged to each pixel from the discharge heads 31*k*, 31*c*, 31*m*, 31*y* and 41*w*. At this time, the computer 9 makes the amount of ink discharged to one pixel (i.e. discharge amount) different between the discharge heads 31*k*, 31*c*, 31*m* and 31*y* for the color inks and the discharge head 41*w* for the white ink. Specifically, a maximum value of the discharge amount of the white ink by the discharge head 41*w* is larger than a maximum of the discharge amounts of the color inks by the discharge heads 31*k*, 31*c*, 31*m* and 31*y*. In this way, the printing of a background image and the compensation of the concealment rate can be performed by a large amount of the white ink.

Figure 2:
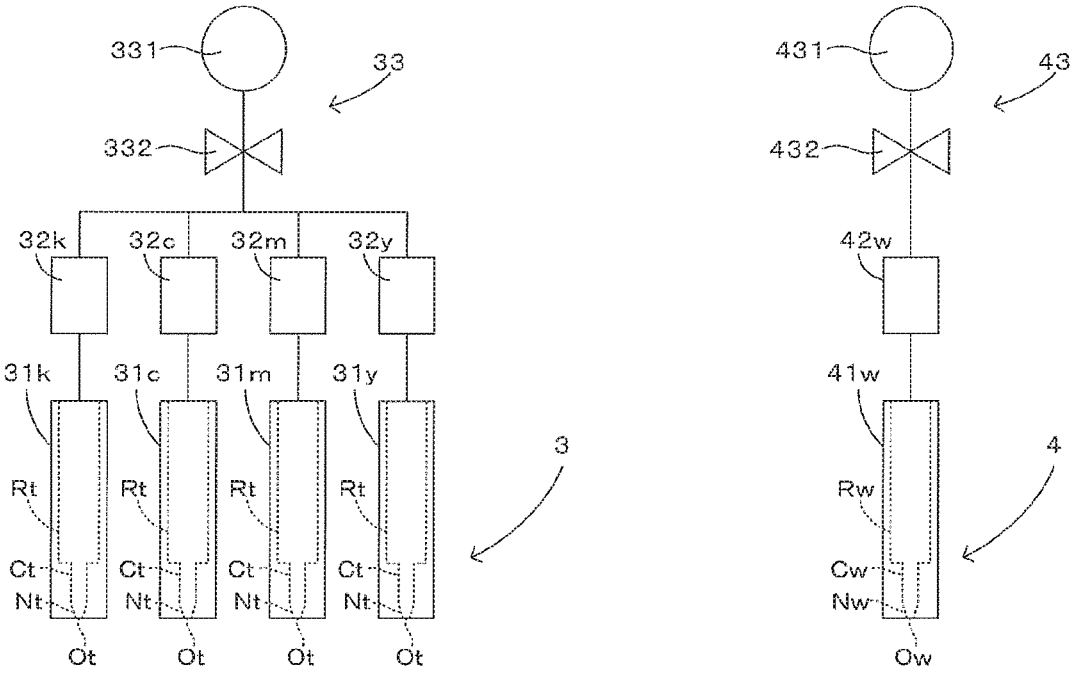
FIG. 2 is a diagram schematically showing a configuration on the discharge heads.

FIG. 2 is a diagram schematically showing a configuration on the discharge heads. The discharge head 31*k* includes a storage chamber Rt that stores the ink, a plurality of pressure chambers Ct communicating with the storage chamber Rt and nozzles Nt provided on the tips of the respective pressure chambers Ct. A piezo element is provided for the pressure chamber Ct. When the piezo element driven by the drive signal Dk applies a pressure to the pressure chamber Ct, the ink is discharged from an opening Ot provided on the tip of the nozzle Nt. Each of the other discharge heads 31*c*, 31*m* and 31*y* similarly includes a storage chamber Rt, pressure chambers Ct and nozzles Nt and discharges the ink from openings Ot of the nozzles Nt in accordance with the drive signal Dc, Dm, Dy.

Further, ink supply mechanisms 32*k*, 32*c*, 32*m* and 32*y* are provided to respectively correspond to the discharge heads 31*k*, 31*c*, 31*m* and 31*y*, and respectively supply the inks to the storage chambers Rt of the corresponding discharge heads 31*k*, 31*c*, 31*m* and 31*y* from sub-tanks built therein. Furthermore, a pressure regulation mechanism 33 is provided in common to the ink supply mechanisms 32*k*, 32*c*, 32*m* and 32*y*. This pressure regulation mechanism 33 forms meniscuses of the inks in the nozzles Nt of the discharge heads 31*k*, 31*c*, 31*m* and 31*y*, for example, by a configuration described in JP 2017-30154A or the like. That is, the pressure regulation mechanism 33 includes a pump 331 and a valve 332 that opens and closes the pump 331 for the ink supply mechanisms 32*k*, 32*c*, 32*m* and 32*y*. If the pump 331 decompresses the insides of the sub-tanks of the ink supply mechanisms 32*k*, 32*c*, 32*m* and 32*y* with the valve 332 opened, a negative pressure is applied to the ink in the nozzles Nt of each discharge heads 31*k*, 31*c*, 31*m*, 31*y*. As a result, the meniscus shaped to correspond to the magnitude of the negative pressure is formed on the ink of each nozzle Nt.

Similarly to the discharge head 31*k*, the discharge head 41*w* includes a storage chamber Rw that stores the ink, a plurality of pressure chambers Cw communicating with the storage chamber Rw and nozzles Nw provided on the tips of the respective pressure chambers Cw. A piezo element is provided for the pressure chamber Cw. When the piezo element driven by the drive signal Dw applies a pressure to the pressure chamber Cw, the ink is discharged from an opening Ow provided on the tip of the nozzle Nw.

Further, an ink supply mechanism 42*w* is provided to correspond to the discharge head 41*w* and supplies the ink to the storage chamber Rw of the discharge heads 41*w* from a sub-tank built therein. Furthermore, a pressure regulation mechanism 43 is provided for the ink supply mechanism 42*w*. This pressure regulation mechanism 43 forms meniscuses of the ink in the nozzles Nw of the discharge head 41*w* by a pump 431 and a valve 432, similarly to the pressure regulation mechanism 33. That is, if the pump 431 decompresses the inside of the sub-tank of the ink supply mechanism 42 with the valve 432 opened, a negative pressure is applied to the ink in the nozzles Nw of the discharge head 41*w*. As a result, the meniscus shaped to correspond to the magnitude of the negative pressure is formed on the ink of each nozzle Nw.

Figure 3:
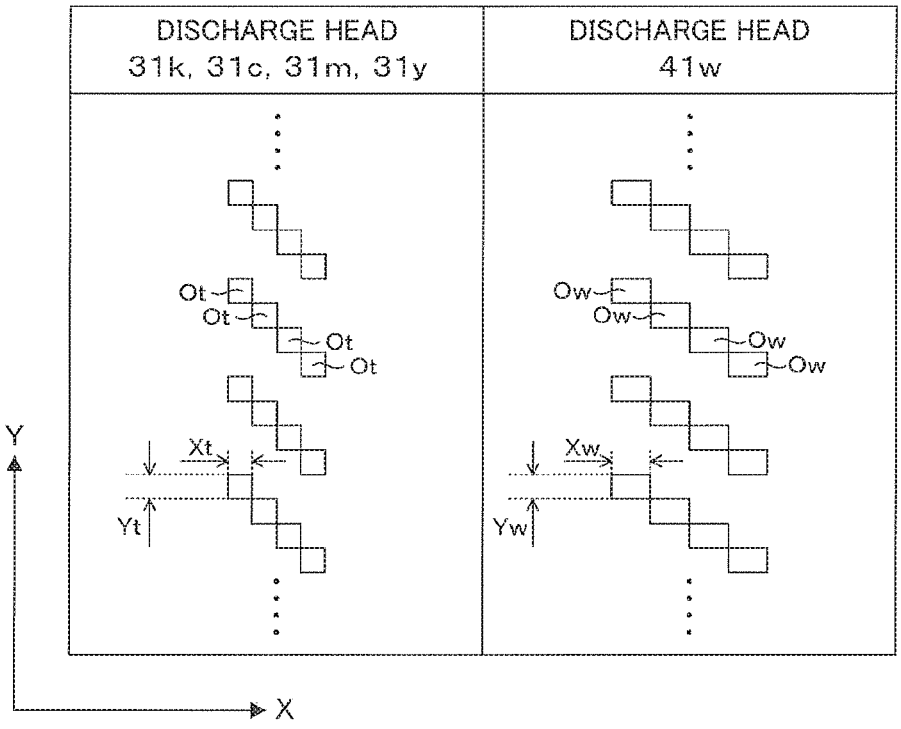
FIG. 3 is a diagram schematically showing the configuration of the openings of the nozzles in the discharge heads.

FIG. 3 is a diagram schematically showing the configuration of the openings of the nozzles in the discharge heads. As shown in a left column of FIG. 3, a plurality of the openings Ot are arrayed in a staggered manner in an array direction Y orthogonal to the conveying direction X in each of the discharge heads 31*k*, 31*c*, 31*m* and 31*y*. Further, as shown in a right column of FIG. 3, a plurality of the openings Ow are arrayed in a staggered manner in the array direction Y in the discharge head 41*w*. Note that although a four-row staggered array is illustrated in FIG. 3, the number of rows of the staggered array is not limited to four. Alternatively, the plurality of openings Ot, Ow can also be linearly arrayed instead of being arrayed in a staggered manner.

The openings Ot of the discharge heads 31*k*, 31*c*, 31*m* and 31*y* have a rectangular shape and have a width Yt in the array direction Y and a length Xt in the conveying direction X. The width Yt and the length Xt are equal. The openings Ow of the discharge head 41*w* have a rectangular shape and have a width Yw in the array direction Y and a length Xw in the conveying direction X. The length Xw is longer than the width Yw. Further, the width Yt of the openings Ot and the width Yw of the openings Ow are equal in the array direction Y, and the length Xw of the openings Ow is longer than the length Xt of the openings Ot in the conveying direction X. Thus, an area (=Yw×Xw) of the openings Ow is larger than an area (=Yt×Xt) of the openings Ot. Specifically, the area of the openings Ow for the white ink may be set 1.1 to 2.5 times as large as the area of the openings Ot for the color inks to correspond to the discharge amount of the white ink, which is 1.1 to 2.5 times as much as the discharge amount of each of the color inks.

As just described, in this embodiment, the area of the openings Ow that discharges the white ink is larger than the area of the openings Ot that discharges the color inks. Since the openings Ow are secured to be large in this way, more white ink can be discharged to one pixel while the number of ink droplets discharged by the multi-drop method is suppressed or without depending on the multi-drop method. As a result, a generation amount of an ink mist can be suppressed while the discharge amount of the white ink is secured.

Further, the following advantage is obtained by making the area of the openings Ow that discharges the white ink larger than the area of the openings Ot that discharges the color inks. That is, since a pigment of the white ink generally has larger particles than pigments of the color inks, such a discharge failure that the openings Ow are clogged with the solidified white ink and the white ink cannot be discharged from the openings Ow has easily occurred. In contrast, by securing the large area of the openings Ow for the white ink, the clogging of the openings Ow that discharge the white ink can be suppressed in performing printing using the white ink. As a result, it is also possible to suppress the frequency of performing maintenance such as purging to solve the clogging by discharging the white ink from the nozzles Nw and wiping to wipe a surface of the discharge head 41*w*, to which the nozzles Nw are formed, by a wiper.

If it is tried to secure the discharge amount of the white ink larger than the discharge amount of the color inks as described above, it has been necessary to input a drive signal Dw having a large amplitude to the discharge head 41*w* to discharge a large amount of the white ink. However, a conveying speed of the sheet S had to be delayed and the efficiency of printing was reduced since this drive signal Dw could not keep up with the conveying speed of the sheet S. In contrast, by making the area of the openings Ow from which the white ink is discharged larger than the area of the openings Ot from which the color ink is discharged, the amplitude of the drive signal Dw required to discharge the white ink can be suppressed to be small and a necessary amount of the white ink can be discharged to the sheet S while the sheet S is conveyed at a high speed. In this way, it also becomes possible to perform efficient printing.

Further, the width Yt of the openings Ot and the width Yw of the openings Ow are equal in the array direction Y and the length Xw of the openings Ow is longer than the length Xt of the openings Ot in the conveying direction X. By making the openings Ow wide in the conveying direction X of the sheet S in this way, efficient printing can be performed by discharging a necessary amount of the white ink while conveying the sheet S at a high speed.

Further, the computer 9 can perform a mode of overlaying the white ink discharged from the discharge head 41*w* and the color inks discharged from the discharge heads 31*k*, 31*c*, 31*m* and 31*y* on the sheer S. By performing such a mode, a sufficient concealment rate of a color image formed by the color inks can be secured by overlaying a large amount of the white ink on the color inks.

Further, the pressure regulation mechanism 43 that forms the meniscuses of the white ink by regulating the pressure of the white ink in the discharge head 41*w* and the pressure regulation mechanism 33 that forms the meniscuses of the color inks by regulating the pressures of the color inks in the discharge heads 31*k*, 31*c*, 31*m* and 31*y* are provided. In such a configuration, the pressure to form the meniscuses of the white ink and the pressure to form the meniscuses of the color inks are individually regulated. Thus, the meniscuses of the white ink and the respective color inks can be properly shaped by giving pressures corresponding to the areas of the respective openings Ow and Ot. Specifically, a negative pressure given to the white ink by the pressure regulation mechanism 43 may be made larger than a negative pressure given to the color inks by the pressure regulation mechanism 33. Here, the magnitude of the negative pressure is given by the magnitude of an absolute value of the negative pressure.

Further, the openings Ow of the base printing unit 4 that discharges the white ink are larger than the openings Ot of the color printing unit 3 that discharges the color inks. In such a configuration, the generation amount of the ink mist can be suppressed while a large amount of the white ink used to print a background image or to compensate for the concealment rate, is secured.

Further, the computer 9 controls such that the maximum value of the amount of the first ink discharged from the openings Ow to one pixel by the base printing unit 4 is larger than the maximum values of the amounts of the color inks discharged from the openings Ot to one pixel by the color printing unit 3. That is, in such a configuration, the openings Ow that discharges the white ink having a larger maximum value of the discharge amount than the color inks is secured to be large. As a result, the generation amount of the ink mist can be suppressed while a large maximum value of the discharge amount of the white ink is secured.

In the embodiment described above, the printing apparatus 1 corresponds to an example of a "printing apparatus" of the invention, the base printing unit 4 corresponds to an example of a "first printing unit" of the invention, the color printing unit 3 corresponds to an example of a "second printing unit" of the invention, the opening Ow corresponds to an example of a "first opening" of the invention, the opening Ot corresponds to an example of a "second opening" of the invention, the white ink corresponds to an example of a "first ink" of the invention, the color ink corresponds to an example of a "second ink" of the invention, the computer 9 corresponds to an example of a "controller" of the invention, the conveying unit 2 corresponds to an example of a "conveying unit" of the invention, the drive signal Dw corresponds to an example of a "first drive signal" of the invention, the drive signal Dk, Dc, Dm, Dy corresponds to an example of a "second drive signal" of the invention, the pressure regulation mechanism 43 corresponds to an example of a "first pressure regulation mechanism" of the invention, the pressure regulation mechanism 33 corresponds to an example of a "second pressure regulation mechanism" of the invention, the sheet S corresponds to an example of a "print medium" of the invention, the conveying direction X corresponds to an example of a "conveying direction" of the invention, and the array direction Y corresponds to an example of a "direction orthogonal to the conveying direction" of the invention.

Note that the invention is not limited to the above embodiment and various changes other than the aforementioned ones can be made without departing from the gist of the invention. For example, a ratio of the area of the openings Ot for the color inks and the area of the openings Ow for the white ink is not limited to the above example and can be changed as appropriate.

Further, magnitude relationships of the width Yt and the length Xt of the openings Ot and the width Yw and the length Xw of the openings Ow can also be changed as appropriate.

Further, the shapes of the openings Ot and the openings Ow are not limited to the above rectangular shapes and may be other shapes such as circular or elliptical shapes.

Further, the method for discharging the inks from the discharge heads 31*k*, 31*c*, 31*m*, 31*y* and the 41*w* is not limited to a piezo method and may be another method such as a thermal method.

Further, the colors of inks usable as the color inks are not limited to the above four colors.

Further, in the above example, back printing of printing an image on a surface opposite to a visible surface is performed. However, the printing apparatus 1 may be configured to perform front printing of printing an image on a visible surface.

Further, also in the printing apparatus 1 using the white ink for applications other than the background image or the compensation of the concealment rate, similar effects can be obtained by configuring the openings Ow, Ot similarly to the above.

Further, also in the case of performing a print to a sheet S which is not transparent, the above configuration is effective. That is, in printing a background image with the white ink on the sheet S that does not transmit light, a large amount of the white ink is used. Accordingly, it is suitable that the generation amount of the ink mist can be suppressed while the discharge amount of the white ink is secured by employing the above configuration.

Further, the color of the ink to be discharged from the base printing unit 4 is not limited to white. That is, the above configuration is effective also in the case of printing a background image or compensating for a concealment rate by an ink of a color other than white.

Further, the printing apparatus 1 with the color printing unit 3 and the base printing unit 4 of a non-circulation type has been illustrated and described. However, a printing apparatus 1 with a color printing unit 3 and a base printing unit 4 of a circulation type can also be configured similarly to the above.

INDUSTRIAL APPLICABILITY

The invention can be applied to printing techniques in general for printing using inks.

REFERENCE SIGNS LIST

1 . . . printing apparatus
2 . . . conveying unit
3 . . . color printing unit
33 . . . pressure regulation mechanism (second pressure regulation mechanism)
4 . . . base printing unit
43 . . . pressure regulation mechanism (first pressure regulation mechanism)
9 . . . computer (controller)
Dw . . . drive signal (first drive signal)
Dk, Dc, Dm, Dy . . . drive signal (second drive signal)
Ow . . . opening (first opening)
Ot . . . opening (second opening)
S . . . sheet (print medium)
X . . . conveying direction
Y . . . array direction (direction orthogonal to the conveying direction)

The invention claimed is:

1. A printing apparatus, comprising:

a conveying unit that conveys a print medium in a conveying direction;

a first printing unit that discharges a first ink to the print medium from a first opening, a second printing unit that discharges a second ink having a color different from a color of the first ink to the print medium from a second opening, and a controller that controls discharge of the first ink from the first opening by the first printing unit and discharge of the second ink from the second opening by the second printing unit, wherein the controller causes the first ink discharged from the first opening at a timing corresponding to a first drive signal to land on the print medium being conveyed in the conveying direction by inputting the first drive signal to the first printing unit, and causes the second ink discharged from the second opening at a timing corresponding to a second drive signal to land on the print medium being conveyed in the conveying direction by inputting the second drive signal to the second printing unit, wherein an area of the first opening is larger than an area of the second opening, and wherein a length of the first opening in the conveying direction is longer than a length of the second opening in the conveying direction, and a width of the first opening in a width direction orthogonal to the conveying direction is equal to a width of the second opening in the width direction.

2. The printing apparatus according to claim 1, wherein the controller causes the first ink discharged from the first printing unit and the second ink discharged from the second printing unit to be overlaid on the print medium.

3. The printing apparatus according to claim 1, further comprising:

a first pressure regulation mechanism that forms a meniscus of the first ink by regulating a pressure of the first ink in the first printing unit; and a second pressure regulation mechanism that forms a meniscus of the second ink by regulating a pressure of the second ink in the second printing unit.

4. The printing apparatus according to claim 1, wherein the first ink is a white ink and the second ink is an ink of a color other than white.

5. The printing apparatus according to claim 1, wherein the controller controls such that a maximum value of an amount of the first ink discharged to one pixel from the first opening by the first printing unit is larger than a maximum value of an amount of the second ink discharged to one pixel from the second opening by the second printing unit.

6. A printing method, comprising:

conveying a print medium in a conveying direction;

discharging a first ink to the print medium from a first opening; and discharging a second ink having a color different from a color of the first ink from a second opening, wherein the discharging the first ink includes causing the first ink discharged from the first opening at a timing corresponding to a first drive signal to land on the print medium being conveyed in the conveying direction, wherein the discharging the second ink includes causing the second ink discharged from the second opening at a timing corresponding to a second drive signal to land on the print medium being conveyed in the conveying direction, wherein an area of the first opening is larger than an area of the second opening, and wherein a length of the first opening in the conveying direction is longer than a length of the second opening in the conveying direction, and a width of the first opening in a width direction orthogonal to the conveying direction is equal to a width of the second opening in the width direction.

* * * * *